US007356853B2

(12) United States Patent
Byrd et al.

(10) Patent No.: US 7,356,853 B2
(45) Date of Patent: Apr. 15, 2008

(54) SPORTS PROTECTION APPARATUS

(76) Inventors: Linda Byrd, 15433 E. St. Hwy. 21, Chireno, TX (US) 75937; James Byrd, 15433 E. St. Hwy. 21, Chireno, TX (US) 75937; Miriam Cheever, 110 Robinhood Dr., Nacogdoches, TX (US) 75961

( * ) Notice: Subject to any disclaimer, the term of this patent is extended or adjusted under 35 U.S.C. 154(b) by 0 days.

(21) Appl. No.: 11/338,600

(22) Filed: Jan. 24, 2006

(65) Prior Publication Data

US 2006/0212999 A1 Sep. 28, 2006

Related U.S. Application Data

(60) Provisional application No. 60/647,258, filed on Jan. 26, 2005.

(51) Int. Cl.
*A41D 13/00* (2006.01)

(52) U.S. Cl. ..... 2/338

(58) Field of Classification Search ..... 2/338, 2/236, 220, 235, 219, 300, 310–328, 920; 128/95.1, 96.1, 97.1, 98.1, 100.1, 101.1, 128/102.1

See application file for complete search history.

(56) References Cited

U.S. PATENT DOCUMENTS 5,492,496 A * 2/1996 Walker ..... 450/155
5,785,671 A * 7/1998 Striano ..... 602/19
6,766,532 B1 * 7/2004 Cabana ..... 2/44

* cited by examiner

*Primary Examiner*—Tejash Patel

(57) ABSTRACT

A sports activity protection apparatus and method of use. The apparatus of the present invention is characterized by a multi-layer padded member and a belt member. The padded member is shaped to offer protection of the abdominal area, including the solar plexus and upper groin region. The padded member contains different layers for absorbing and distributing shock, ensuring flexibility, and providing for a lightweight apparatus. Individual layers are comprised of air-filled bladders, a low density material, foam material, and nylon or similar material. The belt member, preferably comprised of an elastic material, extends between each end of the padded member to be secured about the waist of the user.

2 Claims, 2 Drawing Sheets

(10)

SPORTS PROTECTION APPARATUS

CITATION TO PRIOR APPLICATION

This application claims the benefit of U.S. Provisional Application No. 60/647,258, filed on Jan. 26, 2005.

BACKGROUND OF THE INVENTION

1. Field of the Invention

The present invention generally relates to a sports activity protection apparatus. More specifically, the present invention relates to a sports activity protection apparatus having a padded member of multi-layer configuration, where each layer performs particular functions and acts in complementary fashion to provide for a particularly effective apparatus. The padded member is secured about the waist of its user by a belt member and serves to protect the abdomen from incident blows from sports balls and other players.

2. Background Information

The use of various padding and other protective equipment for use during sports activity is known. More specifically, sports activity protection apparatus heretofore devised and utilized are known to consist basically of familiar, expected and obvious structural configurations, notwithstanding the myriad of designs encompassed by the prior art which have been developed for the fulfillment of different objectives and requirements. While these devices may fulfill their respective, particularly claimed objectives and requirements, the aforementioned devices do not disclose a sports activity protection apparatus and method of use such as Applicant's present invention.

Known sports activity protection apparatuses are hampered by limitations overcome by Applicant invention. More specifically, devices known in the art do not provide a protection mechanism that is both light weight and particularly effective in absorbing and distributing shock. In fact, those skilled in the art largely agree that a glaring limitation associated with such products is remaining light enough to avoid hindering sports performance while offering adequate protection. While there are known products that may secure about the waist or torso of a sports player, such products sacrifice mobility for the benefit of more protection, and vice versa. After all, until now, protection devices have not been able to offer adequate shock absorption while remaining light enough to be worn while running at full speed.

Those playing sports games, such as soccer, where there is a likelihood of having contact with sports balls or other players would be well served to be equipped with a device such as the present invention. That is, those playing such games would greatly benefit from a device that could be worn during games or practice, with no detrimental effect to performance, while offering superior protection. As will be fully discussed, Applicant's invention, through a novel arrangement of component parts, provides such an apparatus.

SUMMARY OF THE INVENTION

The general purpose of the present invention, which will be described subsequently in greater detail, is to provide a new sports activity protection apparatus and method of use which has many of the advantages of such apparatus known in the art and many novel features that result in a new apparatus and method of use which is not anticipated, rendered obvious, suggested, or even implied by any of the known apparatus or methods, either alone or in any combination thereof.

In satisfaction of the above, the present invention provides a sports activity protection apparatus and method of use that is new and unobvious in view of known products. The present invention, by way of a novel multi-layer configuration, provides for a particularly effective sports protection apparatus and method of use with respect to performance, durability, flexibility, and size-to-weight ratio. In fact, results achieved by the present invention are simply not possible with any other known treatments.

In its most preferred form, the padded member of the present apparatus is generally of an elongate shape, having a broader center section while being tapered about each distal end. Such a configuration is particularly beneficial in that it allows its user a free range of motion while protecting the most vulnerable parts of the body. More specifically, this configuration allows a sports player to bend, twist, or rotate at the waist without restriction while offering protection of the solar plexus and groin area. Particular embodiments are envisioned where the padded member is of different dimensions, sized according to whether it is to be used by a child or an adult. As such, the general arrangement of component layers of the padded member remains the same, while its actual dimension may vary to better suit the size of the player wearing the padded member.

The apparatus of the present invention provides for a padded member secured about the waist of its user by a belt member. The belt member extends from each distal end of the padded member to wrap around the waist of a sports player. The belt member may be securely fastened by any number of arrangements as known in the art. For example, the belt may contain plastic clips that fit into one another. Particular embodiments are envisioned where the belt member is elastic and may be put on by either "stepping into" the apparatus, or pulling it down from over the head. Such an embodiment is particularly useful for quickly changing into, and out of, the apparatus during the course of a game or practice. Finally, in its most preferred form, the belt member is actually comprised of two individual belts that wrap around the waist of the player. Two smaller belts are preferred over a single larger belt as such an arrangement maintains a more secure fit as the player's body moves during use.

The padded member is characterized by a multi-layer configuration, where each layer performs a specific function. Each layer, alone and in combination with other layers, imparts several novel attributes to Applicant's invention. The, first, or outermost layer is comprised of some material such as nylon or some composite thereof. This layer provides strength for holding the apparatus together and flexibility in allowing the apparatus to contour to the shape of its user. Further, the outer layer is particularly beneficial in that it is somewhat breathable and does not induce agitation or itching for its user as the apparatus is worn.

The second outermost layer is juxtaposed with the inside of the first layer and the outside of a third layer. This second layer functions primarily as a protection for the inner layers, adding durability and water resistance to the device.

A relatively thin third layer is juxtaposed with the inside of the second layer and the outside of a fourth layer. Of course, the third layer does provide some degree of protection by simply acting as an additional layer of padding; however, the third layer largely serves to eliminate relative movement between the second and fourth layers. That is, the third layer is comprised of some course material that essentially "grabs" the second and fourth layers. Without this layer, the apparatus would be of diminishing usefulness over time as the protective materials contained within became distorted under the outside material. In fact, a common problem associated with known protective members is "bunching" of protective material as the player moves during the course of its use. In novel fashion, Applicant's invention eliminates any such problem.

The fourth layer is juxtaposed with the inside of the third layer and the outside of a fifth layer. In its most preferred form, this layer is comprised of a foam material and is approximately between one eighth and one quarter inch in thickness. This foam layer provides for shock absorption and distribution, and, provides structural integrity to the apparatus overall.

The fifth layer is juxtaposed with the inside of the fourth layer and the outside of the sixth (or inner most) layer. The fifth layer is thick batting layer; however, it is somewhat similar to the second layer in so much as it is comprised of a course material that "grabs" surrounding layers to hold each intact with respect to the other. This layer is particularly effective in protecting the inner most layer, which contains air-filled bladders, from abrasive forces that may cause damage. Finally, while this layer may be relatively thick (preferably being between one quarter to one half inch thickness), its porous nature contributes to the apparatus being relatively light weight.

The sixth or innermost layer is positioned within the central-most portion of the apparatus. Preferably, this layer is made up of a dual layered system of some plastic component having a series of air-filled bladders. This layer serves as the core of the apparatus and is excellent in responding to forces exerted thereon. More specifically, the air filled bladders efficiently react to the force imparted by objects contacting the padded member and respond to bending or folding of the padded member caused by the player's movement during use. Finally, this innermost layer may have air bladders of different dimensions to better accommodate the expected strength of incident forces (i.e., adults may need greater protection in most instances) and comprise one or more layers to further provide protection.

While the apparatus of the present invention may seem trivial at first glance, its unique construction proves otherwise. That is, the combination of layers having foam padding and air-filled bladders provides for excellent shock absorption. Also, these layers are malleable enough to withstand bending and folding of the apparatus caused by the users' movement during use. Additional layers are sandwiched throughout the apparatus to ensure the constituent layers do not slip or slide with respect to each other. These layers are relatively porous and therefore do not impart undue mass to the apparatus. Moreover, these layers provide their own level of shock absorption and further serve to protect other constituent layers.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
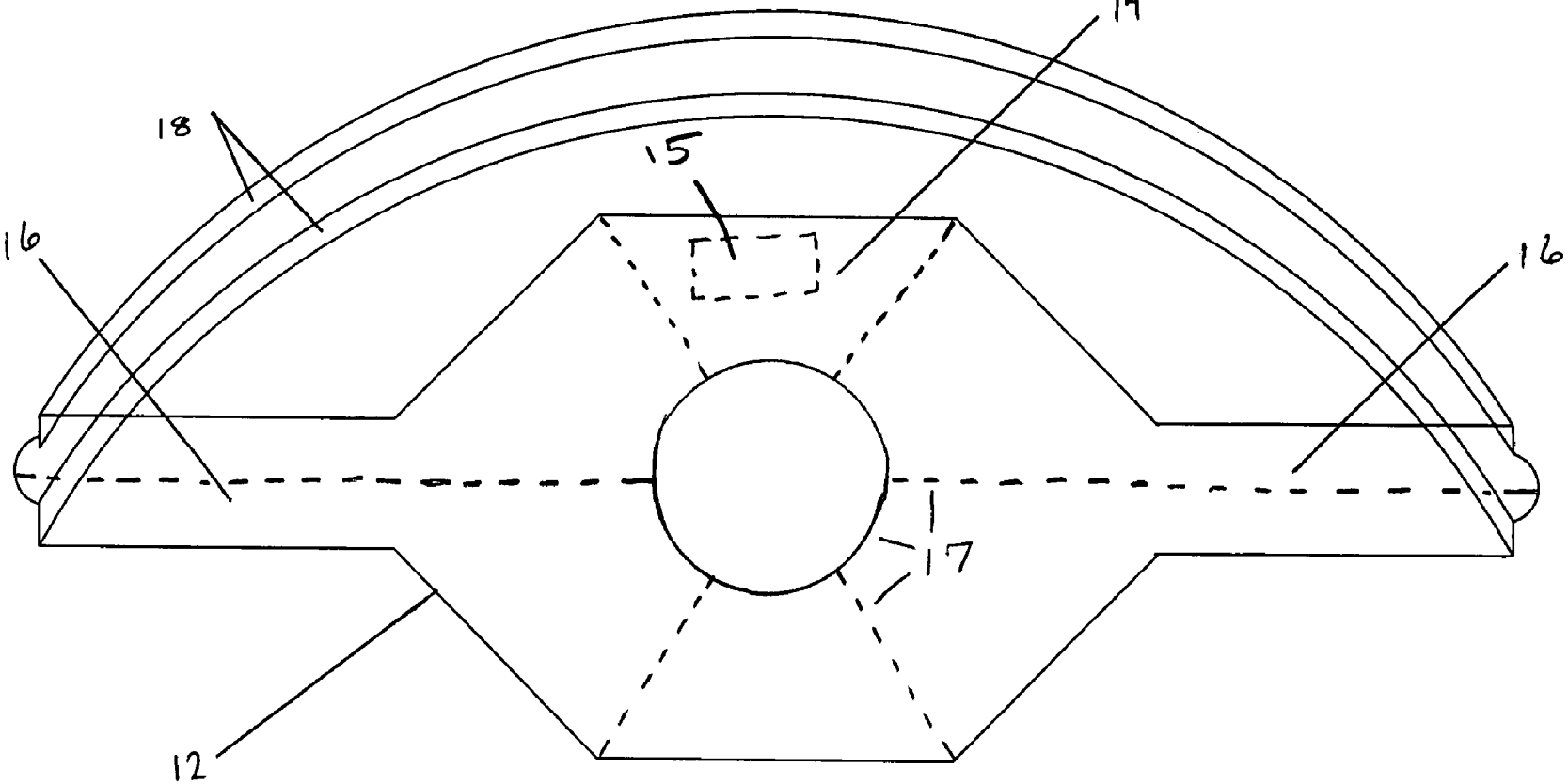
FIG. 1 is a perspective view of the apparatus of the preferred embodiment of the present invention.

Referring to FIG. 1, the apparatus of the present invention is generally designated by the reference numeral 10. Apparatus 10 is primarily characterized by a padded member 12 in combination with a belt member 18.

Padded member 12, in the preferred embodiment, is generally of an elongate shape, having a broader center section 14 while being tapered about each distal end 16. As send in FIG. 1, padded member 12 is held together via stitching members 17. Such a configuration is particularly beneficial in that it allows its user a free range of motion while protecting the most vulnerable parts of the body. More specifically, this configuration allows a sports player to bend, twist, or rotate at the waist without restriction while offering protection of the solar plexus and groin area. Particular embodiments are envisioned where padded member 12 is of different dimensions, sized according to whether it is to be used by a child or an adult. As such, the general arrangement of component layers of padded member 12 remains the same, while its actual dimensions may vary to better suit the size of the player wearing apparatus 10. Finally, padded member 12 may include a hidden zipper pocket 15 located on the back upper portion of padded member 12.

Apparatus 10 is further characterized by belt member 18, which serves to secure padded member 12 about its user. Belt member 18 extends from each distal end 16 of padded member 12 to wrap around the waist of a sports player. Belt member 18 may be securely fastened by any number of securing means as known in the art. For example, the connecting portions of belt 18 may contain plastic clips that fit into one another. Particular embodiments are envisioned where belt member 18 is comprised of elastic or a similar material so that apparatus 10 may be put on by either "stepping into" the apparatus, or pulling it down from over the head. Such an embodiment is particularly useful for quickly changing into, and out of, the apparatus during the course of a game or practice. Finally, in its most preferred form, belt member 18 is actually comprised of two individual belts that wrap around the waist of the player. Two smaller belts are preferred over a single larger belt as such an arrangement maintains a more secure fit as the player's body moves during use.

Figure 2:
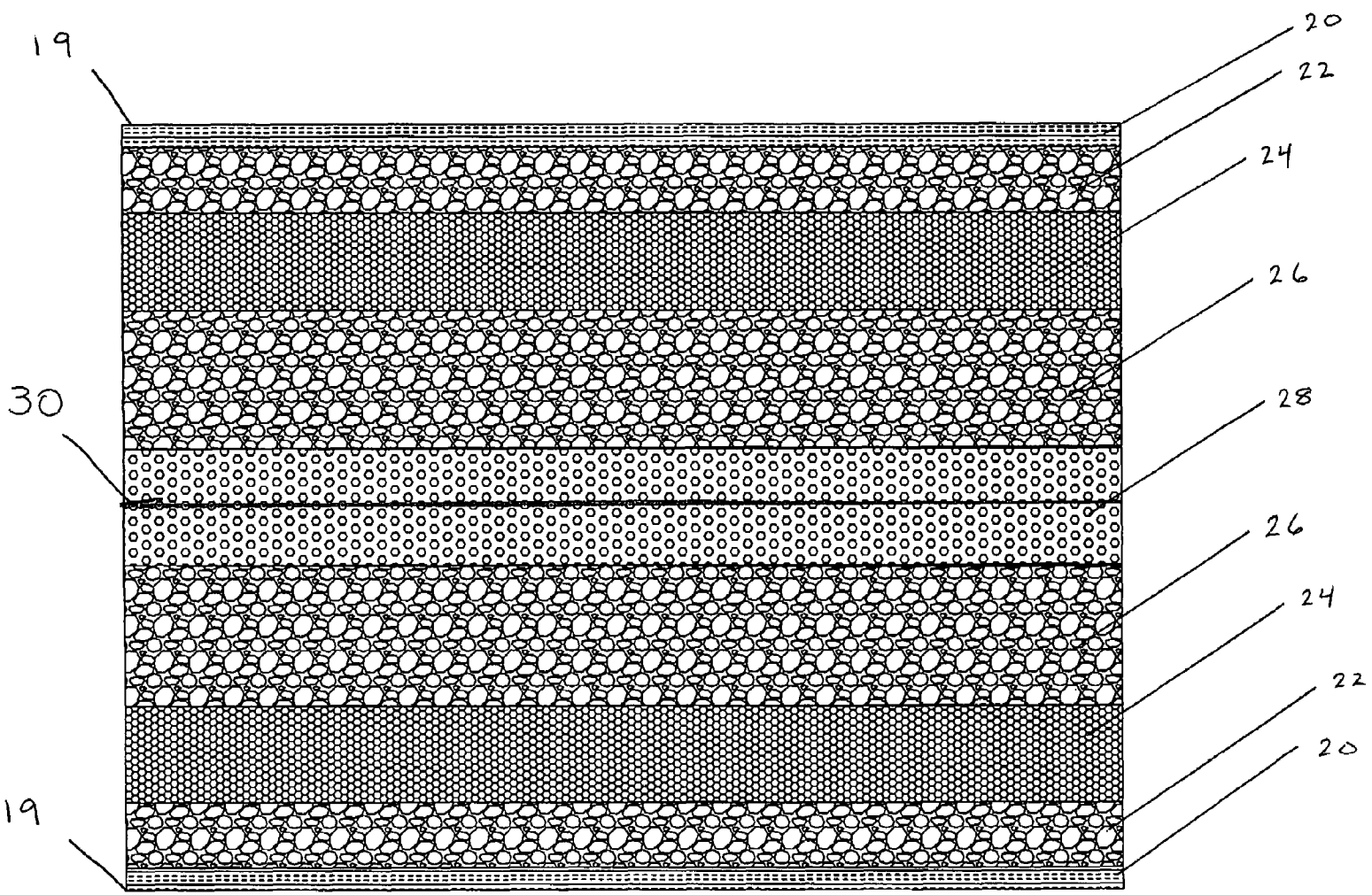
FIG. 2 is a cross section view of the apparatus of the preferred embodiment of the present invention.

Referring to FIG. 2, padded member 12 is characterized by a multi-layer configuration, where each layer performs a specific function. Each layer, alone and in combination with other layers, imparts several novel attributes to Applicant's invention. Layer 19, the outermost layer is comprised of a thin, breathable nylon composite. This layer provides protection of the other components of the apparatus while maintaining a comfortable feel for the user in that it is breathable and does not induce agitation for its user during use. Finally, layer 19 may be produce in a variety of colors and designs in order to better fit the desired application or activity of its user.

Next, layer 20 is juxtaposed with the inside of layer 19 and the outside of layer 20. Layer 20 is comprised of a thicker, more durable layer of material such as nylon or some composite thereof. This layer is highly water resistant and provides strength for holding apparatus 10 together and flexibility in allowing apparatus 10 to contour to the shape of its user.

Layer 22 is juxtaposed with the inside of layer 20 and the outside layer 24. Layer 22 in the preferred embodiment is a quilted fabric layer of material. Layer 22 is relatively thin, yet of course, does provide some degree of protection by simply acting as an additional layer of padding. Importantly, layer 22 provides for efficient manufacturing of device 10. That is, layer 22 aids as a filler so that an assembly needle, sewing the constituent components together, can more easily penetrate through layer 20. Also, layer 22 serves to reduce relative movement between layer 20 and layer 24. That is, the outer surface of layer 22 is comprised of some course material that essentially "grabs" the layer 20 and layer 24. Without this layer, apparatus 10 would be of diminishing usefulness over time as the protective materials contained within become distorted under the outside material. In fact, a common problem associated with known products is "bunching" of protective material as the player moves during the course of use. However, as discussed, Applicant's invention eliminates any such problem.

Layer 24 is juxtaposed with the inside of layer 22 and the outside of layer 26. In its most preferred form, this layer is comprised of a foam material and is preferably between one eighth and one quarter inch in thickness. This foam layer provides for shock absorption and distribution, and, provides structural integrity and added thickness to the apparatus overall.

Layer 26 is juxtaposed with the inside of layer 24 and the outside of layer 28 (the inner most layer). Layer 26 is a thick batting layer; however, it is similar to layer 22 in so much as it is comprised of a course, and relatively porous, material that "grabs" surrounding layers to help hold each intact with respect to the other. Layer 26 is particularly effective in protecting layer 28, which contains air-filled bladders 30, from abrasive forces that may cause damage. Finally, while layer 26 may be relatively thick (preferably being between one quarter to one half inch thickness), its low density nature contributes to relatively light weight of apparatus 10.

Layer 28 is the innermost layer of apparatus 10. Preferably, layer 28 is a dual layered system of some plastic component having a series of air-filled bladders 30. This layer serves as the core of the apparatus and is excellent in responding to forces exerted thereon. More specifically, air-filled bladders 30 efficiently react to forces imparted by objects contacting padded member 12 and respond to bending or folding of padded member 12 caused by the player's movement during use. Finally, layer 28 may have air bladders 30 of different dimensions to better accommodate the expected strength of incident forces (i.e., adults may need greater protection in most instances) and may comprise one or more layers to further provide protection.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A protective device comprising:

a padding member, said padding member being characterized by a central portion sized and shaped to substantially cover and protect the abdomen region of a user when said protective device is worn by said user, said padding member being further characterized by a first and second elongate portion extending from distal ends of said central portion, said padding member being characterized by a multi-layer configuration;

a belt member, said belt member being secured to and extending between said first and second elongate portions, said belt member being configured to adjustably fit about the waist or torso of said user;

wherein said padding member is comprised of:

an innermost layer, said inner most layer having a first and second side, said innermost layer being characterized by an arrangement of air filled bladders;

a first and second inner layer, said first and second inner layers each having a first and second side, said first side of said first inner layer being juxtaposed along said first side of said innermost layer, said first side of said second inner layer being juxtaposed along said second side of said innermost layer, said first and second inner layers being comprised of a porous, batting material;

a third and fourth inner layer, said third and fourth inner layer each having a first and second side, said first side of said third inner layer being juxtaposed along said second side of said first inner layer, said first side of said fourth inner layer being juxtaposed along said second side of said second inner layer, said third and fourth inner layers being comprised of a fabric-backed foam material;

a fifth and sixth inner layer, said fifth and sixth inner layers each having a first and second side, said first side of said fifth inner layer being juxtaposed along said second side of said third inner layer, said first side of said sixth inner layer being juxtaposed along said second side of said fourth inner layer, said fifth and sixth inner layers being comprised of a quilted, porous material;

a seventh and eighth inner layer, said seventh and eighth inner layers each having a first and second side, said first side of said seventh outer layer being juxtaposed along said second side of said fifth inner layer, said first side of said eighth inner layer being juxtaposed along said along said second side of said sixth inner layer, said seventh and eighth inner layers being comprised of a durable, water resistant material; and a first and second outer layer, said first and second outer layers each having a first and second side, said first side of said first outer layer being juxtaposed along said second side of said seventh inner layer, said first side of said second outer layer being juxtaposed along said second side of said eighth inner layer, said first and second outer layers being comprised of a durable, breathable material.

2. The device of claim 1 further comprising a hidden zipper pocket attached to said padding member.

* * * * *